US005417260A

United States Patent [19]

Perrier

[11] Patent Number: 5,417,260

[45] Date of Patent: May 23, 1995

[54] METERING-OUT DEVICE, A METERING-OUT VALVE, AND APPARATUS FOR TIMED METERING OUT OF LIQUID

[76] Inventor: René Perrier, 91, rue Fernand Lafont, 07160 Le Cheylard, France

[21] Appl. No.: 132,303

[22] Filed: Oct. 6, 1993

[30] Foreign Application Priority Data

Oct. 9, 1992 [FR] France ..... 92 12372

[51] Int. Cl.[6] ..... B65B 43/42; B67C 3/00

[52] U.S. Cl. ..... 141/146; 141/140; 141/258; 141/261; 222/167

[58] Field of Search ..... 141/26, 144, 145, 146, 141/147, 140, 157, 258, 259, 260, 261, 262; 222/167, 168, 168.5, 169, 170, 171, 380

[56] References Cited

U.S. PATENT DOCUMENTS 3,097,672 7/1963 Minard ..... 141/146
3,252,619 5/1966 Miller ..... 141/146
3,335,767 8/1967 Manas ..... 141/147
3,841,363 10/1974 Stigler ..... 141/146
5,027,983 7/1991 Wakabayashi et al. ..... 141/258
5,240,049 8/1993 Chiari ..... 141/258

*Primary Examiner*—Renee S. Luebke
*Assistant Examiner*—Steven O. Douglas
*Attorney, Agent, or Firm*—Young & Thompson

[57] ABSTRACT

The invention relates to a metering-out device for taking successive timed doses of liquid from a tank, the device comprising a body for mounting in fixed manner relative to the tank and including a liquid-taking plunger with motion transmission means for driving the plunger with reciprocating motion in the liquid so that in one direction the liquid is metered out and in the opposite direction it is pumped. The invention also provides a metering-out valve including such a metering-out device, and metering-out apparatus including such a metering-out valve.

42 Claims, 5 Drawing Sheets

METERING-OUT DEVICE, A METERING-OUT VALVE, AND APPARATUS FOR TIMED METERING OUT OF LIQUID

The invention relates to timed metering out of successive predetermined quantities of liquid taken from a tank, each metered-out quantity or "dose" of liquid being fed into a container such as a bottle, a can, etc.

BACKGROUND OF THE INVENTION

In industrial installations for handling, processing, or filling a series of containers such as bottles, cans, etc., at a high rate, it is sometimes essential during transfer of the containers to inject a predetermined dose of liquid into each container. The dose is often of small volume (conventionally lying in the range 0.1 ml to 10 cl), and the liquid is sterile since it is intended for human or animal consumption or for making up pharmaceuticals or toiletries.

Since the containers are processed in large numbers at a very high rate, the problem arises of being able to provide an automatic metering-out apparatus capable of delivering very small volume doses of liquid at a very high rate, with great accuracy, and with great reliability.

Known metering-out apparatuses are either entirely manual, i.e. driven by a person, in which case they do not have the required reliability and accuracy, or else they include electromechanical, electronic, or even computer devices that are extremely complex and expensive and that are difficult to adjust in operation. In addition, known electronic or computer devices are not very compatible with installations for handling, processing, or filling bottles since such installations are essentially mechanical and thus may perform operations that are inaccurate or random. Similarly, devices that are electrically driven are not very compatible with the liquid in the environment of such installations for handling, processing, or filling containers.

Various types of liquid-metering pumps are known which suck up a predetermined quantity of liquid from a duct and then deliver it into another duct. Nevertheless, such pumps are not entirely compatible with operation at a high rate for the purpose of metering out very small quantities, and they are not sufficiently accurate and reliable. For example, mere wear of sealing rings can give rise to an unacceptable change in the volume pumped and metered out.

OBJECTS AND SUMMARY OF THE INVENTION

The invention therefore seeks to remedy the above drawbacks by providing a metering-out device, a metering-out valve including such a device, and metering-out apparatus including such a metering-out valve, enabling small quantities of liquid to be successively metered out at a high rate with good dynamic accuracy in operation of the metered-out volume regardless of operating conditions, and providing good reliability over time.

Another object of the invention is to propose such metering-out apparatus that is entirely mechanical and that includes no electronic or electromechanical devices.

The invention also seeks to provide such a metering-out device, metering-out valve, or apparatus for metering out that is extremely simple and cheap to manufacture.

Another object of the invention is to provide such a metering-out device, metering-out valve, or apparatus for metering out that is extremely compact, in particular in a horizontal plane, in order to enable it to be incorporated at any location in an installation for handling, processing, or filling containers at a high rate.

The invention also seeks to provide such a metering-out device, metering-out valve, or apparatus for metering out capable of operating not only at a rate that is high, but also at a rate that may vary at any moment and that may vary randomly, while nevertheless ensuring that each container receives a highly accurate dose of liquid.

The invention also seeks to provide such a metering-out device, metering-out valve, or apparatus for metering out that can be used, for example, for metering out quantities of liquid in the range 0.1 ml to 10 cl with an error of less than 10%, and in particular of about 2%, at rates that may lie in the range 0 to 120,000 containers per hour.

The invention also seeks, simultaneously, to provide a metering-out device, a metering-out valve, and apparatus for metering out that are compatible with the use of sterile liquids such as foodstuffs or pharmaceuticals, and which are therefore easily cleaned, designed to avoid any development of infection, and suitable for being completely purged.

Finally, the invention seeks to provide apparatus for metering out that enables the size of the dose to be adjusted while in operation and without interrupting operation.

To do this, the invention provides a metering-out device for timed taking of successive doses of liquid from a tank, which device comprises a metering-out body for being mounted stationary relative to the tank and includes a liquid-taking plunger that is mounted movable relative to the metering-out body and that is designed to be immersed in the liquid, and motion transmission means for driving said plunger with reciprocating motion in the liquid, thereby obtaining one direction for metering out a predetermined quantity of liquid and an opposite direction for pumping it.

The use of an immersed reciprocating plunger in the metering-out device of the invention provides, in particular, the advantages of being able to operate at a very high rate while taking very small quantities, of enabling synchronization to be obtained extremely simply with the drive applied to the containers that are to receive the liquid, while still enabling operation to be performed under completely hygienic and sterile conditions and without using any kind of electrical, electronics, or computer device.

In accordance with the invention, the liquid-taking plunger is hollow, being provided with a liquid-insertion opening leading to a liquid-taking chamber which communicates with an outlet channel formed in the body of the metering-out device, and the plunger carries a shutter arranged to be opened in the direction of motion that generates metering out and to be closed in the direction of motion that generates pumping. In accordance with the invention, the shutter is of the type that is controlled by the pressure of the liquid generated by the reciprocating motion of the liquid-taking plunger in the liquid. For example, and in accordance with the invention, the shutter may be constituted by a shutter member mounted to slide freely or to pivot relative to the plunger in the chamber.

The reciprocating motion of the liquid-taking plunger in the liquid may be of any kind, i.e. it may take place in any direction and it may be any kind of motion in translation and/or in rotation. Preferably, and in accordance with the invention, the reciprocating motion is vertical translation motion.

In accordance with the invention, the metering-out device has a leakage section that is less than the section of the shutter opening when open, and which is provided between the liquid-taking chamber and the outside of the plunger in contact with the liquid in the tank. The function of this leakage section is to enable the reciprocating motion of the plunger to be maintained in the liquid even when the outlet channel remains closed. For example, and in accordance with the invention, this leakage section may, be less than one-tenth of the section of the opening and it may be constituted merely by the transverse play in the guiding contact between the outside surface of the plunger which is in the form of a piston and the guide surface of a housing formed in the body of the metering-out device for guiding the plunger. Thus, no sealing gasket is used between the plunger piston and the guide housing for said plunger piston.

In accordance with the invention, the metering-out device includes drive means for creating the motion of the plunger in at least one direction of motion, and in particular in said direction only, with the opposite direction of motion being transmitted from motion created outside the metering-out device. In accordance with the invention, the drive means create the plunger motion in the direction for metering out, and they are constituted by a return spring.

The means for transmitting the motion of a metering-out device of the invention include a rod that is rigidly associated with the plunger and that extends through the liquid-taking chamber and the outlet channel to cooperate firstly with the drive means and secondly with a moving member outside the metering-out device.

In accordance with the invention, the cross-section of the liquid-taking chamber is greater than the cross-section of the insertion opening and the cross-section of the outlet channel. Furthermore, the cross-section of the outlet channel tapers from the liquid-taking chamber to the outlet end of the outlet channel outside the body of the metering-out device.

By means of a metering-out device of the invention, it will be observed that the speed and pressure of metering out do not depend on the rate at which metering out takes place since the device includes drive means in the form of a return spring. Thus, measurement accuracy is not affected when the rate is changed or when said rate becomes extremely high. Furthermore, the simplicity in operation and in structure of the device, in particular its lack of sealing gasket, provides great operating reliability and extremely long operating lifetime.

The invention also provides a metering-out valve for time taking and delivery of successive predetermined quantities of liquid, in particular a sterile liquid such as a food liquid, a cosmetic, or a pharmaceutical, the liquid being taken from a tank and transferred to containers of any kind (bottles, cans, flasks, . . . ) placed successively and in timed manner beneath a spout of said metering-out valve, which valve is wherein it includes at least one metering-out device of the invention whose outlet channel communicates with a delivery channel formed in a valve body and opening out into the spout. In accordance with the invention, the outlet channel of the metering-out device and the delivery channel define a path that is continuously rising or partially horizontal between the insertion opening of the plunger of the metering-out device and the spout. As a result, the liquid circuit between the tank and the spout has no low point or high point in which centers of infection could become established.

In accordance with the invention, the metering-out valve includes a delivery shutter member interposed on the delivery channel in the body of the valve and caused to open when a container is facing the spout, and to close when no container is facing the spout. Thus, in a metering-out valve of the invention, the operation of metering out and pumping each quantity of liquid is entirely independent of the operation controlling the delivery of the liquid into the container. As a result, each operation can be performed by controlled shutter means that are extremely simple. In particular, this is made possible by the leakage section of the metering-out device since the device can continue to operate even when the delivery channel is closed.

In accordance with the invention, the delivery shutter is caused to open by a moving control member that is displaced during positioning of a container to face the spout, and that is closed by a return spring.

Similarly, the metering-out valve of the invention includes a non-return valve interposed between the delivery shutter and the outlet channel of the metering-out device, serving to prevent liquid from flowing in the return direction back to the tank. The non-return valve thus prevents the metering-out valve becoming unprimed in the event of operation coming to a halt or in the event of the metering-out device being disassembled from the body of the valve, thus preserving general hygiene and sterility.

In a metering-out valve of the invention, the metering-out device is rigidly associated relative to the body of the valve to ensure continuity of the delivery channel and of the outlet channel of the metering-out device, but in a manner that is removable so as to enable the metering-out device to be disassembled and changed. In accordance with the invention, the body of the valve is connected to the body of the device by means of a coupling. The coupling also includes means for releasable and rigid association with the tank. Preferably, and in accordance with the invention, the coupling forms a common fixing bracket for fixing the body of the metering-out device and the body of the valve relative to the tank. In accordance with the invention, this coupling includes a non-return valve.

In addition, the invention also provides metering-out apparatus for successive timed taking and delivery of predetermined quantities of liquid, in particular a sterile liquid, the liquid being delivered into containers driven successively and in timed manner by drive means, said metering-out apparatus comprising a stand constituting a tank for the liquid and being wherein it includes at least one metering-out valve of the invention mounted on the stand so that each metering-out device has its liquid-taking plunger immersed in the liquid contained in the tank. Thus, metering-out apparatus of the invention is constituted overall by a stand forming a tank and carrying at least one metering-out valve that includes a liquid-taking plunger immersed in the liquid and that is driven with reciprocating motion in said liquid in order to generate timed metering out and pumping of quantities of the liquid.

In accordance with the invention, the operation of the liquid-taking plunger of the metering-out device in the apparatus is controlled, at least in part, from the motion of the container drive means, a predetermined quantity of liquid being taken at the operating rate of said drive means.

In metering-out apparatus of the invention, motion of the liquid-taking plunger in one direction is controlled from the motion of the container drive means and is therefore synchronized therewith, whereas motion of the liquid-taking plunger in the opposite direction is controlled by its own drive means integrated in each metering-out device, e.g. in the form of a return spring. As a result, not only is metering out synchronized with the operating rate of the container drive means, but also accuracy concerning the quantity of liquid delivered to each container is ensured, regardless of the rate of throughput. In accordance with the invention, the metering-out motion is controlled by the motion of the container drive means while the pumping motion is controlled by the return spring.

The metering-out apparatus of the invention also includes a control cam for co-operating with a cam follower slide or wheel in each metering-out device so as to impart the metering-out motion thereto, the cam and the stand that forms the tank being movably mounted relative to each other by motion generated by the container drive means. In accordance with the invention, the control cam is rigidly associated with the stand by means for adjusting the distance between said control cam and the metering-out devices. This adjustable distance makes it possible to modify the amplify the amplitude of the stroke of the liquid-taking plunger in the liquid, and thus to adjust the volume of the quantity metered out, even while the equipment is in operation.

In accordance with the invention, the tank stand includes projections for engaging in the slots or orifices of a moving member of the container drive means so as to impart motion to the stand, the associated control cam being stationary (but adjustable in position), since it is secured to a stationary support. Thus, in metering-out apparatus of the invention, it is the entire tank-forming stand carrying the metering-out valves that is movable and that has motion imparted thereto. In particular, the metering-out apparatus of the invention is in the form of a carousel, the tank being circularly symmetrical and occupying a bottom central position, the stand including a peripheral ring for supporting a plurality of regularly spaced-apart metering-out valves. The metering-out devices extend vertically along and on the inside of the cylindrical vertical walls of the tank, and the stand is extended upwards by an extension, the control cam being a circular cam rigidly associated with a guide bearing for guiding the extension above the metering-out device.

The invention also provides an installation for handling, processing, or filling a series of containers of any kind such as bottles or the like, wherein it includes at least one metering-out apparatus of the invention. In particular, the installation of the invention includes a metering-out apparatus rigidly associated above a plate of a rotary inlet or outlet star of a carousel for handling, processing, or filling containers.

The invention also provides a metering-out device, a metering-out valve, a metering-out apparatus, and a handling installation including in combination all or some of the characteristics specified above or below. In particular, the invention provides a metering-out device, including, in combination, a leakage section as specified above and its own self-contained drive means integrated in the metering-out device to impart motion to the plunger in one direction, in particular in the pumping direction.

BRIEF DESCRIPTION OF THE DRAWINGS

Other characteristics and advantages of the invention appear on reading the following description of preferred embodiments given purely by way of non-limiting example, and described with reference to the accompanying figures, in which.

DETAILED DESCRIPTION OF THE INVENTION

Figure 1:
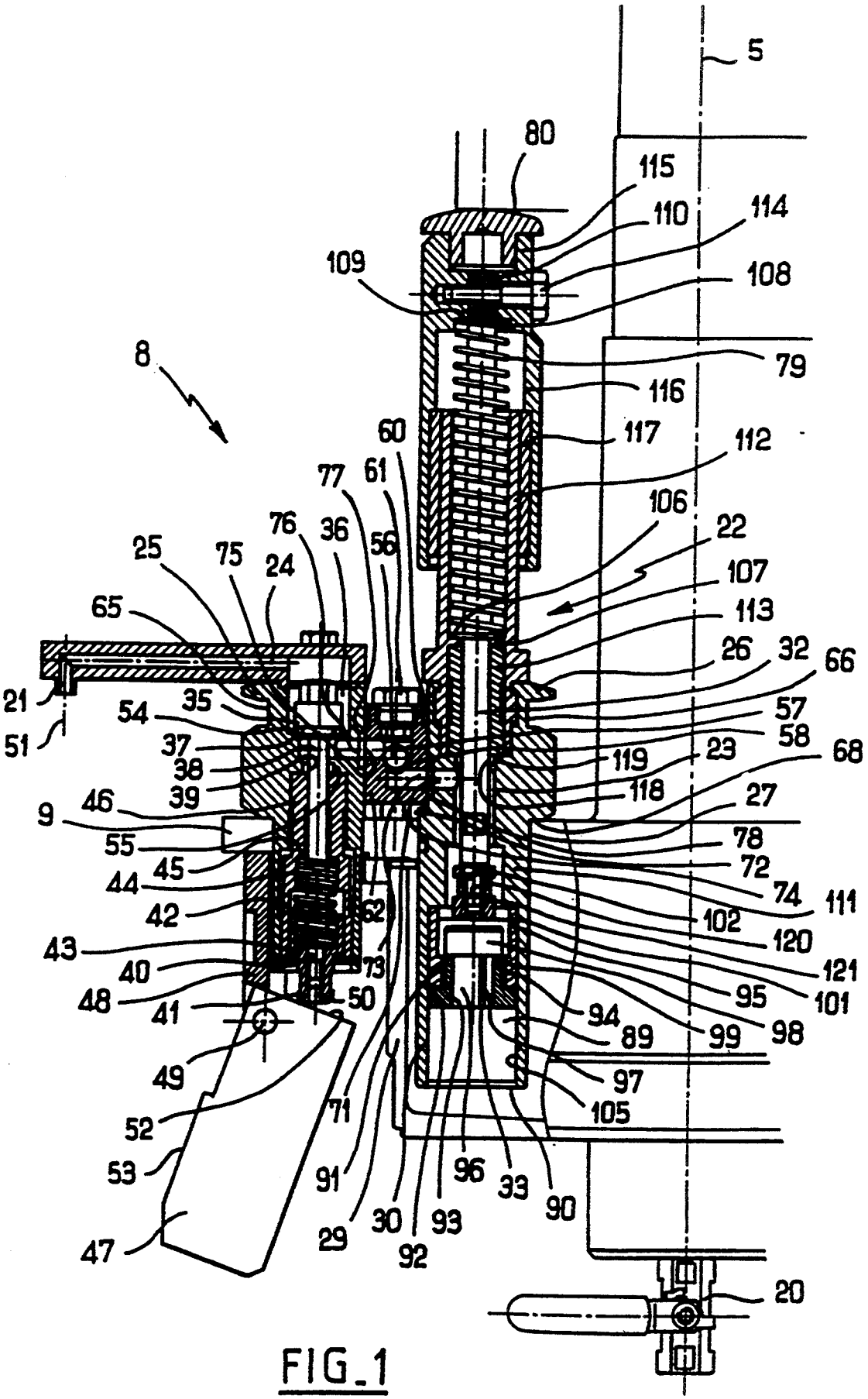
FIG. 1 is a vertical section through a metering-out valve of the invention.

The invention relates to metering-out apparatus 1 for timed and successive taking of predetermined. quantities of liquid and delivery thereof into containers 2. The metering-out apparatus 1 of the invention is more particularly adapted to metering out sterile liquids such as foods, cosmetics, pharmaceuticals, or similar liquids, but it could equally well be applied to other liquids, e.g. additives for petroleum products, components of chemical mixtures such as detergents, paints, etc. . . . . As an example of a sterile liquid, mention may be made of food additives (flavorings, liquors, coloring agents, preservatives, . . . ) or even liquid foods per se in the finished product state, such as beverages, sauces, . . . . The invention is more particularly applicable to liquids in a homogeneous or colloidal solution, but it could also be used with liquids that are heterogeneous to some extent.

The nature of the container itself is of no importance in the context of the invention which is thus applicable to all kinds and sizes of container, bottles made of glass or of plastics, cans, jars, flasks, tanks, vats, . . . .

The containers 2 are generally driven in a timed succession by drive means 3. In the example shown in the figures, the drive means 3 are constituted by a rotary inlet or outlet star of a carousel for handling, processing, or filling the containers and implemented in conventional manner by means of at least one turntable 3 in the general form of a ring provided with peripheral recesses 4 for receiving the containers 2. The turntable 3 is rotated about a vertical axis 5 by drive means (not shown) e.g. constituted by the electrical or hydraulic motor of the carousel or belonging to the star.

The metering-out apparatus 1 comprises a main stand 6 in the form of a tank 7 for storing the liquid concerned.

Figure 4:
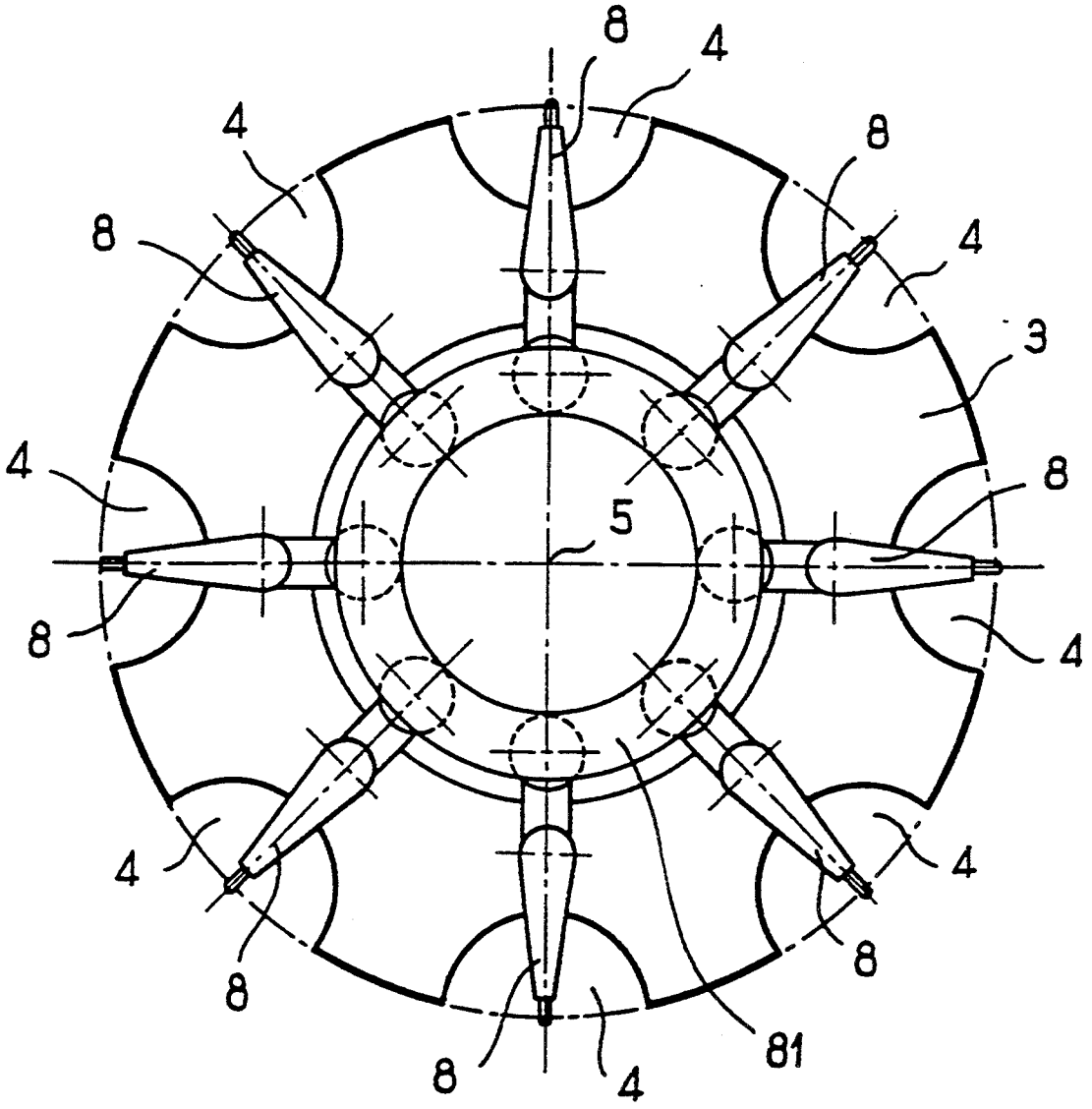
FIG. 4 is a view of the FIG. 3 metering-out apparatus of the invention on line IV—IV after it has been installed on an inlet or outlet star of a carousel for handling, processing, or filling containers.

The metering-out apparatus 1 of the invention includes at least one metering-out valve 8 which is secured to the stand 6. In the example shown, the metering-out apparatus 1 comprises a plurality of metering-out valves, with FIG. 4 showing eight such metering-out valves in a regularly distributed configuration. The metering-out apparatus 1 shown is in the form of the carousel per se, the tank 7 being centrally positioned in the bottom thereof, and its stand including a peripheral ring 9 supporting eight metering-out valves 8 that are uniformly spaced apart angularly.

Figure 5:
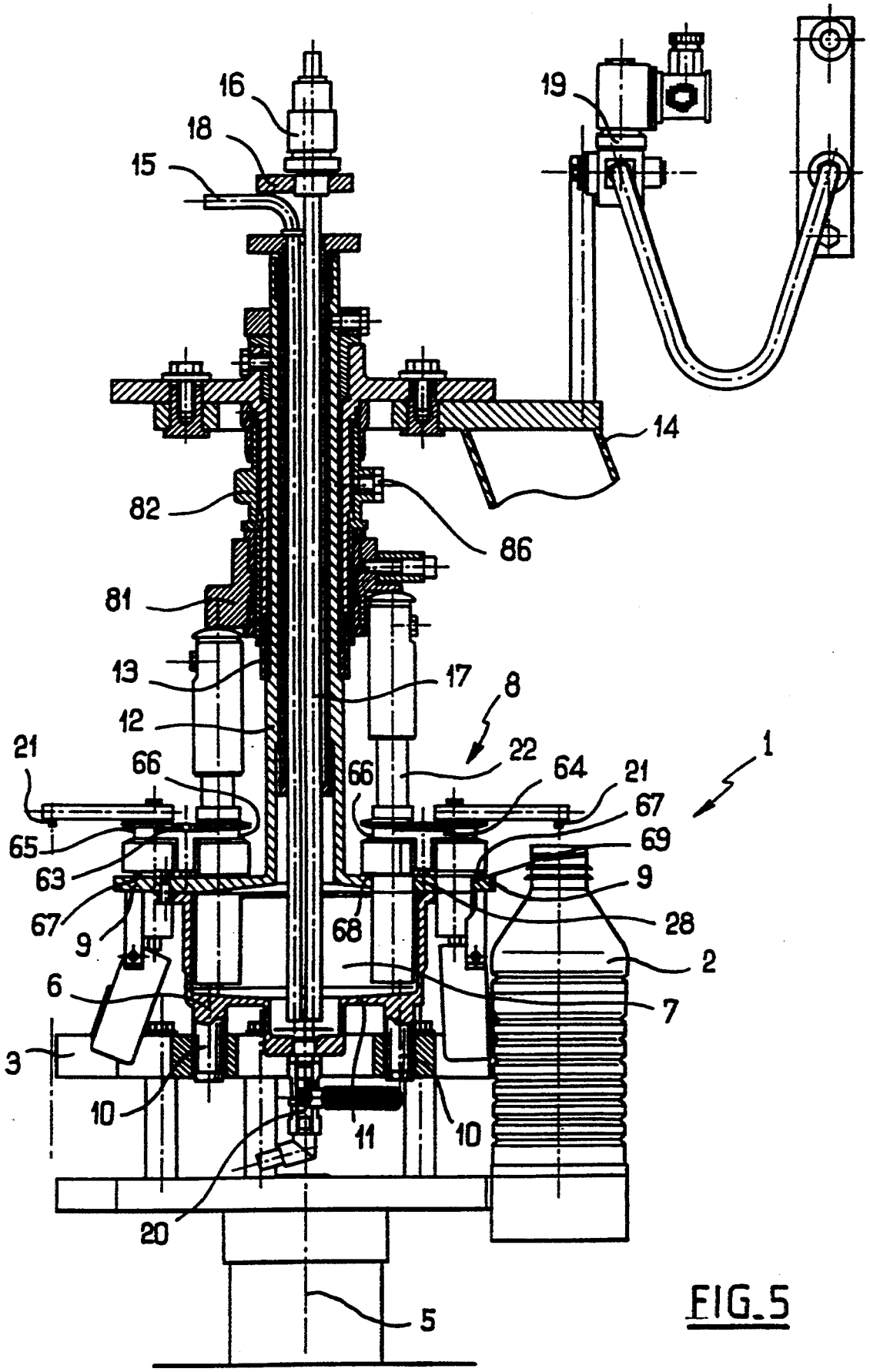
FIG. 5 is a vertical section view through metering-out apparatus of the invention installed on an inlet or outlet star of a carousel.

FIGS. 4 and 5 show an example of an installation of the invention in which the metering-out apparatus 1 is rigidly associated with the top of a turntable of a rotary inlet or outlet star of a carousel for handling, processing, or filling containers. For this purpose, the stand 6 forming the tank 7 includes vertical projections 10 that project vertically downwards from the bottom wall 11 of the tank. These projections 10 are engaged in vertical-axis slots or orifices in the turntable 3 so that the rotary motion of the turntable 3 is transmitted directly to the stand 6 by means of the projections 10.

The stand 6 is extended vertically upwards beyond the peripheral ring 9 by an extension 12 that is held and guided in rotation about the vertical axis 5 by means of a guide bearing 13 mounted on a bracket 14 that is stationary relative to the ground. Liquid is fed into the tank 7 via a feed tube 15 engaged in the free top end of the extension 12 which is hollow. The feed tube 15 extends vertically down the extension 12 into the central bottom portion of the tank 7. In addition, the level of liquid in the tank is kept constant by means of a probe 16 carried by a support 18 that is fixed relative to the ground and that is extended downwards by a probe tube 16 that also extends through the extension 12 down to the central bottom portion of the tank 7. The probe 16 controls the operation of an electrically controlled valve 19 which controls the flow of liquid through the feed tube 15 and coming from a feed pump (not shown). The metering-out apparatus 1 of the invention thus comprises a bottom central tank 7 and means 15, 16, 17, 18, and 19 for keeping the level of liquid in said tank 7 above a predetermined threshold. The tank 7 is also provided with an emptying valve 20 in its bottommost central portion.

Each metering-out valve 8 operates in timed manner to keep taking the same predetermined quantity of liquid and to deliver that quantity into respective successive containers that are themselves successively placed in timed manner beneath a spout 21 of the metering-out valve 8. Each valve 8 includes at least one metering-out device 22 containing an outlet channel 23 from which each dose of liquid is ejected from the device into a delivery channel 24 provided in a valve body 25 that carries the spout 21 and that is in communication with the outlet channel 23. The delivery channel 24 opens out at the spout 21 which points towards the openings of the containers 2. The liquid leaves the metering-out valve 8 via the spout 21.

Each device 22 comprises a metering-out body 26 for mounting in a stationary position relative to the tank 7. The body 26 is generally cylindrical and it extends vertically through a circular opening 27 in an at least substantially horizontal wall 28 of the stand 6 that covers the tank 7 like a lid. This wall 28 of the stand 6 is extended beyond the peripheral cylindrical wall 29 of the stand 6 that forms the tank 7 by means of the peripheral ring 9 supporting the metering-out valves 8.

The metering-out body 26 extends vertically beneath the lid-forming wall 28 so that its bottom end portion 30 is immersed in the liquid contained in the tank 7.

Each metering-out device 22 includes a plunger 31 for taking liquid that is mounted so as to move relative to the body 26 of the device, which plunger is immersed in the liquid. The device 22 also includes means 32 for transmitting motion so as to impart reciprocating motion to the plunger 38 in the liquid, thereby giving rise, in one direction to a predetermined quantity of liquid being metered out, and in the opposite direction so said liquid being pumped towards the outlet channel 23.

In accordance with the invention, the outlet channel 23 of the device 22 and the delivery channel 24 define a continuously rising or partially horizontal path running from an opening 33 for inserting liquid into the plunger 31 of the device 22 and the spout 21. As a result, the liquid flow duct between the tank 7 and the spout 21 includes no high point and no low point in which liquid or air can accumulate.

Each metering-out valve 8 includes a delivery shutter 34 interposed in the delivery channel 24 and caused to open when a container 22 faces the spout 21, and to close otherwise, i.e. when there is no container 2 beneath the spout 21.

The delivery shutter 34 is constituted by a vertical axis cylindrical valve member 35 extending in a vertical position 36 of the delivery channel 24. The bottom end of this vertical portion 36 tapers to form a seat 37 for the valve member 35, the diameter of said seat being less than the outside diameter of the valve member 35. The valve member 35 is carried at the free end of a vertical valve rod 38 which extends downwards through a vertical bore 39 formed through the body 25 of the valve. The free bottom end 40 of the valve rod 38 is rigidly associated with a stud 41 projecting vertically downwards outside the valve body 25. The stud 41 slides vertically relative to the valve body 25 in a guide housing 42 having vertical walls, and it forms a bottom abutment 43 bearing against a compression spring 44 placed around the valve rod 38. The other end of the spring 44 bears against a top shoulder 45 secured to the valve body 25. As a result, the stud 41, the valve rod 38, and the valve member 35 are permanently urged downwards by the return spring 44 which thus serves to close the shutter 34. In the embodiment of FIG. 1, a guide ring 46 is provided between the valve rod 38 and the valve body 25 and it forms a top shoulder 45 for the spring 44. The guide ring 46 is extended downwards to form the guide housing 42, and is thus also interposed between the stud 41 and the valve body 25.

The delivery shutter 34 is opened by a control member 47 that is movable relative to the valve body 25 and that is displaced when a container 2 is put into place facing the spout 21. The control member 47 is constituted by a shoe 47 hinged relative to a support 48 mounted on the valve body 25 and/or on the stand 6. The shoe 47 is hinged to its support 48 about a horizontal axis 49. The horizontal axis 49 about which the control shoe 47 pivots is situated in a vertical plane interposed between the vertical sliding axis 50 of the valve rod 38 and the vertical axis 51 of the spout 21. The control shoe 47 includes a face 52 that extends at a slight incline relative to the horizontal between the pivot axis 49 of the shoe 47 and the tank 7 so as to come into contact with the stud 41. The center of gravity of the shoe 47 is placed in such a manner that its contact face 52 which makes contact with the stud 41 is returned to come into contact with said stud 41 merely under the influence of the weight of the shoe 47 which generates torque on the shoe 47 about the pivot axis 49.

The shoe 47 also includes a face 53 that co-operates with the wall of a container 2. The return spring 44 is rated so as to oppose the return torque of the shoe 47 under the effect of its own weight. As a result, when no container is present, the face 53 moves towards the vertical axis 51 of the spout 21 because of the stud 41 pushing back the face 52 under drive from the spring 44. The valve 35 comes into contact with the seat 37 and the delivery channel 24 is closed. A gasket 54 is provided between the valve member 35 and its seat 37. Similarly, a sealing gasket 55 is provided around the valve rod 38 beneath the guide ring 46 in order to avoid any leaks via the bore 39. On the left of FIG. 2, the shutter 34 is shown in its closed position. On the right of FIG. 2 and in FIG. 3, the shutter 34 is shown in its open position, the wall of a container 2 pushing back the face 53 of the shoe 47 against the spring 44, and the face 52 of the shoe 47 pushing the stud 41 upwards because of the shoe pivoting about the axis 49.

In addition, in accordance with the invention, each metering-out valve 8 includes a non-return valve 56 interposed between the delivery shutter 34 and the outlet channel 23 of the metering-out device 22 so as to prevent liquid flowing back into the tank 7. In the embodiment shown, the non-return valve 56 is constituted by a ball 56 placed in a housing 57 in the delivery channel 24, and co-operating with a horizontal seat 58 formed by a narrowing in a vertical portion 59 of the delivery channel 24. The housing 57 extends far enough upwards to allow the ball 56 to lift off the seat 58 under pressure of the liquid coming from the metering-out device 22. In the absence of any such pressure, or in the presence of reverse pressure, the ball 56 comes into contact with the seat 58 and automatically closes the delivery channel 24. A tapped hole 60 closed by a screw 61 is placed about the ball 56 to give access to the housing 57. In addition, the portion of the delivery channel 24 that extends beyond the housing 57 towards the spout 21 is smaller in diameter than the ball 56 so as to prevent the ball from escaping from the housing 57.

In accordance with the invention, the metering-out device 22 is rigidly associated via its body 26 with the body 25 of the valve as a whole, but in removable manner so as to enable the metering-out device 22 or the valve body 25 to be changed. To do this, the valve body 25 is connected to the metering-out device body 26 by means of a coupling 62 which includes means 63 for removable rigid association with the stand 6 of the tank 7. The coupling 62 forms a common fixing bracket for fixing the metering device body 26 and the valve body 25 relative to the stand 6 of the tank 7. To do this, the coupling 62 interposed between the valve body 25 and the body 26 of the metering-out device includes ribs 64 extending horizontally in a horizontal peripheral groove 65 of the valve body 25, and on the other side in a horizontal peripheral groove 66 of the body 26 of the metering-out device. The ribs 64 bear against the horizontal walls of the grooves 65 and 66 so as to hold both of the bodies 25 and 26 pressed against the peripheral ring 9 and the horizontal wall 38 of the stand 6. The valve member 25 includes a thrust shoulder 67 bearing against the peripheral ring 9 of the stand 6, and the metering-out device body 26 includes a thrust shoulder 68 bearing against the horizontal body 38 forming the lid of the stand 6. The valve body 25 also extends beneath the peripheral ring 9 through a slot 69 formed through said peripheral ring 9. The means 63 for removably associating the coupling 62 and the stand 6 may be constituted by two screws 53 having heads engaged in vertical bores formed in the coupling 62 and having threaded ends that co-operate with vertical tapped holes 71 formed in the horizontal wall 38 of the stand, or else in a nut or a spacer 72 rigidly associated with said stand 6. When the screws 63 are tightened into the tapped holes 71, the coupling 62 is urged against the valve body 25 and against the body 26 of the metering-out device. The bodies 25 and 26 are urged against the ring 9 by the coupling 62 and they are held in the slots 69 and 27. To disassemble the assembly, it suffices to loosen the two screws 63, and the metering-out valve 8 comes apart into three portions: the valve body 25; the coupling 62; and the metering-out device 22.

In accordance with the invention, the coupling 62 includes the above-described non-return valve 56, i.e. the portion 59 of the delivery channel 24, the housing 57 with the seat 58 for the ball, and the ball 56. The delivery channel 24 thus passes through the coupling 62 from an orifice 73 that faces the outlet orifice 74 of the outlet channel 23 to an orifice 75 that faces an orifice 76 of the delivery channel 24 and formed in the body 25 of the valve. Sealing may be provided at the orifices by means of O-rings 77 and 78 placed in the housings of the valve body 25 and of the metering-out device body 26.

The metering-out apparatus 1 of the invention thus includes at least one, and generally a plurality of, metering-out valves 8 mounted on the stand 6 so that each of the metering-out devices 22 has its liquid-taking plunger 31 immersed in the liquid. Operation of each liquid-taking plunger 31 is controlled, at least in part, from the motion of the drive means 3 for driving the containers, i.e. at the operating rate of said drive means 3. More precisely, the motion of the liquid-taking plunger 31 in one direction or the other, and in particular its metering-out motion, is controlled by the motion of the drive means 3, whereas the opposite motion of the liquid-taking plunger in the opposite direction, in particular its pumping motion, is controlled by specific drive means 79 integrated in each metering-out device 22. In accordance with the invention, the pumping motion of the liquid-taking plunger 31 is controlled by a return spring 79.

To control the metering-out motion of the liquid-taking plunger 31 from the drive means 3, each metering-out device 22 includes a cam following slide or wheel 80 connected to the liquid-taking plunger 31 by transmission means 32, and the metering-out apparatus 1 includes a control cam 81 for co-operating with each of the cam followers 80 for generating said metering-out motion. The control cam 81 and the stand 6 are movable relative to each other in relative motion driven by the motion of the drive means 3 for driving the containers 2. In the embodiment shown, the control cam 81 is rigidly associated with the stand 6 by means 82 for adjusting the distance between said control cam 81 and each of the metering-out devices 22, i.e. the cam followers 80. The control cam 81 is rigidly fixed relative to the stationary support bracket 14, but via adjustment means 82. In the embodiment shown of the invention, the control cam 81 is a generally circular cam whose helical bearing surface is rigidly associated with the guide bearing 13 on the extension 12 of the stand 6 above the metering-out devices 22. The adjustment means 82 are constituted by a vernier 82 formed by a micrometer screw thread 83 around the guide bearing 13, and by a peripheral nut 85 with a complementary micrometer screw thread 84 and having the control cam 81 rigidly associated therewith. As a result, by turning the nut 85, the overall height of the control cam 81 relative to the metering-out device 22 and to the cam follower 80 is adjusted. The amplitude of the stroke of the liquid-taking plunger 31 in the liquid during the metering-out motion is thus adjusted at will, thereby adjusting the total quantity of liquid metered out on each motion. This common adjustment of all of the metering-out devices 22 can thus, optionally, be performed even while the apparatus is in operation, and it can be performed extremely accurately. A radial locking screw 86 serves to lock the nut 85 relative to the guide bearing so as to prevent any unwanted rotation during operation.

The liquid-taking plunger 31 of the metering-out device 22 is hollow, and its bottom end is provided with an opening 33 for inserting liquid into an internal liquid-taking chamber 87 which communicates with the outlet channel 23 formed in the body 26 of the device. The liquid-taking chamber 87 thus extends inside the body 26 of the metering-out device, from the insertion opening 33 up to the bottom end 88 of the outlet channel 23. This bottom end 88 of the outlet channel 23 opens out into a cylindrical guide housing 89 formed in the bottom portion 30 of the device body 26 for the purpose of guiding the plunger 31 in its reciprocating motion in vertical translation. The liquid-taking chamber 87 is thus variable in volume depending on whether the plunger 31 is in the high portion of the housing 89 in contact with the bottom end 88 of the outlet channel 23, or, on the contrary, whether it is in position below the free bottom end 90 of the metering-out device body 26.

The plunger 31 carries a shutter member 91 for shutting the opening 33. The shutter member 91 is disposed to open during motion in the direction that gives rise to metering out, i.e. when the plunger 31 is moving downwards, and to close in the direction of motion that gives rise to pumping, i.e. when the plunger 31 is moving upwards.

In accordance with the invention, the closure member 91 is of the type controlled by the pressure of the liquid generated by the reciprocating motion of the plunger 31. It is constituted by a shutter member 91 slidably mounted relative to the plunger 31 within the liquid-taking chamber 87.

Thus, in the metering-device of the invention, the plunger 31 is mounted to move in vertical translation relative to the body 26 of the metering-out device, and the motion transmission means 32 drive the plunger 31 with reciprocating vertical translation motion upwards and downwards. The liquid-taking chamber 87 is disposed above the insertion opening 33, and the closure member 91 closes the opening 33 during upwards motion of the plunger 31 and opens it during downwards motion thereof. The plunger 31 is constituted by a hollow plunger piston guided in the bottom housing 89 formed in the body 26 of the metering-out device at the bottom end 88 of the outlet channel 23 that communicates with the liquid-taking chamber 87. The bottom portion of the hollow plunger piston 31 is constituted by a plug support 92 which includes a vertical cylindrical bore 93 and which is provided with an outside thread screwed into tapping 94 of the main cylinder 95 forming the plunger piston 31. The shutter member 91 thus forms a plug for the bore 93 of the plug support 92. For this purpose, the shutter member 91 includes a bottom cylindrical portion 96 engaged in the bore 93 of the plug support 92 and which includes at least one through channel 97 extending vertically for the purpose of passing liquid between the bore 93 and the cylindrical portion 96. The bottom cylindrical portion 96 is extended upwards by a cylindrical top portion 98 whose diameter is greater than the diameter of the bore 93 of the plug support 92, so as to form a shoulder 99 in association with the bottom cylindrical portion 96, which shoulder 99 comes into contact with the top horizontal face 100 of the plug support 92 for the purpose of closing the through channel 97.

The main cylinder 95 of the plunger 31 extends around the top portion 98 of the shutter 91 in an upwards direction to form the bottom portion of the liquid-taking chamber 87. The top portion 101 of said main cylinder 95 is connected by spokes to the free bottom end 102 of a rod 32 forming the above-mentioned transmission means. These spokes naturally leave vertical through openings 103 for the liquid. The top portion 98 of the shutter member 91 moves inside the bottom portion of the liquid-taking chamber 87 between the free bottom end 102 of the transmission rod 32 and the plug support 92. When the plunger piston 31 moves down inside the housing 89, the top portion 98 of the shutter 91 moves up to come into contact with the free bottom end 102 of the transmission rod 32. In this position, the liquid passes through the opening 33 constituted by the right cross-section of the through channel(s) 97 formed in the cylindrical bottom portion 96 of the shutter member 91 that slides in the bore 93. The liquid thus arrives in the bottom portion of the liquid-taking chamber 87, and then passes through the openings 103. In contrast, when the liquid-taking plunger piston 31 moves upwards inside the housing 89, the top portion 98 of the shutter member 91 moves back downwards until the shoulder 99 comes into contact with the top horizontal face 100 of the support of the plug 92, with liquid no longer being able to pass through since the opening 33 is closed.

In accordance with the invention, the metering-out device 22 includes a leakage section between the liquid-taking chamber 87 and the liquid in the tank 6, with the value of said section being less than the section of the insertion opening 33 when the shutter member 91 is open. This leakage section is smaller, e.g. it is less than one-tenth of the section of the opening 33, and in the embodiments shown, it is implemented merely by leaving transverse contact clearance for guidance purposes between the outer surface 104 of the plunger piston 31 and the guide surface 105 of the housing 89 in the bottom portion 30 of the metering-out device body in which the plunger piston 31 slides. Thus, in accordance with the invention, the liquid-taking plunger piston does not include a gasket or a sealing segment between its cylindrical outside surface 104 and the surface 105 of the cylindrical housing 89 which guides it. As a result, a certain amount of leakage is possible between the outside surface 104 of the plunger piston 31 and said guide surface 105. Surprisingly, it has been discovered that the presence of this leak has no effect on accuracy or on reliability of the metering-out device 22 of the invention. Indeed it has a contrary effect. From the point of view of accuracy, it has been observed that this leak is constant in the metering-out device 22 of the invention regardless of the throughput rate. From the point of reliability, the lack of any sealing gasket considerably increases the lifetime of the metering-out device 22. Furthermore, the flow of liquid between the plunger piston 31 and its housing 89 provides a degree of lubrication. Also, this leak makes it possible to keep the metering-out device 22 in operation even when its outlet channel 23 is locked because the delivery shutter 34 is closed. During the pumping motion, the plunger piston moves upwards and if the delivery channel shutter 34 is closed, then the liquid moves back down towards the tank 6 by passing between the plunger piston 31 and its housing 89, thereby enabling the plunger piston 31 to move upwards. By maintaining the reciprocating motion, it is possible to impart permanent mixing to the liquid in the tank 6, even when there are no containers, and it is possible to synchronize the motion of the metering-out device 22 solely on the rate at which the containers 2 are driven, even when no container 2 is brought up to the metering-out valve 8 for some exceptional reason. Thus, there is no need to take account of the presence or absence of a container 2 when operating and determining the operating rate of the metering-out device 22.

The leakage section of the metering-out device of the invention may also be achieved in positive manner by channels formed either in the body 26 of the device, at its bottom end 30, or along the guide surface 105 of the housing 89, or in and along the outside surface 104 of the plunger piston 31, or else inside the body of the main cylinder 95 and the plug support 92. In accordance with the invention, a certain amount of leakage must be possible for passing liquid from the liquid-taking chamber 87 to the tank 6 when the shutter member 91 is closed. Naturally, this leakage must be minimal and of very small value, particularly relative to the opening 33 through which liquid is normally inserted during metering out. The leakage must nevertheless be sufficient to enable the plunger piston 31 to move back up under drive from the spring 79 and to do this in timed manner.

The transmission means 32 include a vertical rod 32 originally associated at its free bottom end 102 with the plunger 31 and extending upwards through the liquid-taking chamber 87 and the outlet channel 23. The return spring 79 is a compression spring which extends vertically around the transmission rod 32, which has its bottom end 106 bearing against a bottom shoulder 107 secured to the body 26 of the metering-out device, and which has its top end 108 bearing against a top shoulder 109 secured to the transmission rod 32.

The top end 110 of the transmission rod 32 is associated with the cam follower 80 of the metering-out device 22 for co-operating with the control cam 81 to generate the downwards transmission motion of the rod 32. The return spring 79 causes the transmission rod 32 to move upwards.

The body 26 of the metering-out device is made up of two portions having axes that are vertically in line, namely a bottom portion 111 associated with the stand 6 of the tank, and a top portion 112 extending the bottom portion, the two portions 111 and 112 being rigidly held together by a guide ring 113 interposed between said two portions 111 and 112 for guiding the transmission rod 32. The top portion 112 extends above the guide ring 113 to form a sheath for the compression spring 79. The top free end 110 of the transmission rod 32 is fixed by means of a screw 114 to a support 115 for the cam follower 80. The support 115 of the cam follower is extended downwards by a skirt 116 which extends around the top portion 112 of the body 26 of the metering-out device forming a sheath for the compression spring 79. A guide ring 117 is interposed between the skirt 116 and the outside surface of said top portion 112. Thus, the transposition rod 32 is guided in its vertical translation relative to the body 26 of the metering-out device by means of the guide ring 113 interposed between the bottom portion 111 and the top portion 112, and by the guide ring 117 interposed between the skirt 116 of the cam follower support 115 and the top portion 112 forming a sheath for the compression spring 79. The cam follower support 115 carries the cam follower 80 at its free top end, which cam follower may be constituted equally well by means of a slide or by means of a wheel, etc. The length of the skirt 116 and of the top portion 112 forming the sheath for the compression spring 79 is defined as a function of the maximum vertical stroke that it is desired to give to the transmission rod 32 and to the liquid-taking plunger 31.

Starting from its bottom end 102, the transmission rod 32 extends vertically upwards through the outlet channel 23 which it leaves via an orifice 118 through the bottom portion 111 of the body 26 of the metering-out device, which orifice is provided with a sealing ring 119. The orifice 118 is immediately extended by the guide ring 113 which is secured in a cylindrical housing in the top portion 112. The outlet channel 23 extends horizontally beneath the orifice 112 towards its outlet orifice 74 in the body 26 of the metering-out device.

The cross-section of the liquid-taking chamber 87 is greater than the cross-section of the insertion opening 33 so as to form considerable suction of the liquid in said liquid-taking chamber 87 when the plunger piston 31 moves downwards. In addition, the cross-section of the liquid-taking chamber 87 is greater than the cross-section of the bottom end 88 of the outlet channel 23, and the cross-section of the outlet channel 23 tapers from the liquid-taking chamber 87 to its outlet end 74 from the metering-out device so as to increase the speed of the liquid flowing from the shutter member to said outlet orifice 74. Likewise, the cross-section of the orifice 73 of the coupling 62 facing the outlet orifice 74 of the outlet channel 23 is greater than the cross-section of the liquid ejection spout 21 of the metering-out valve 8. Thus, the speed of the liquid in the outlet channel 23 and in the delivery channel 24 increases continuously or nearly continuously from the closure member 91 for the insertion opening 33 all the way to the liquid ejection spout 21.

Figure 2:
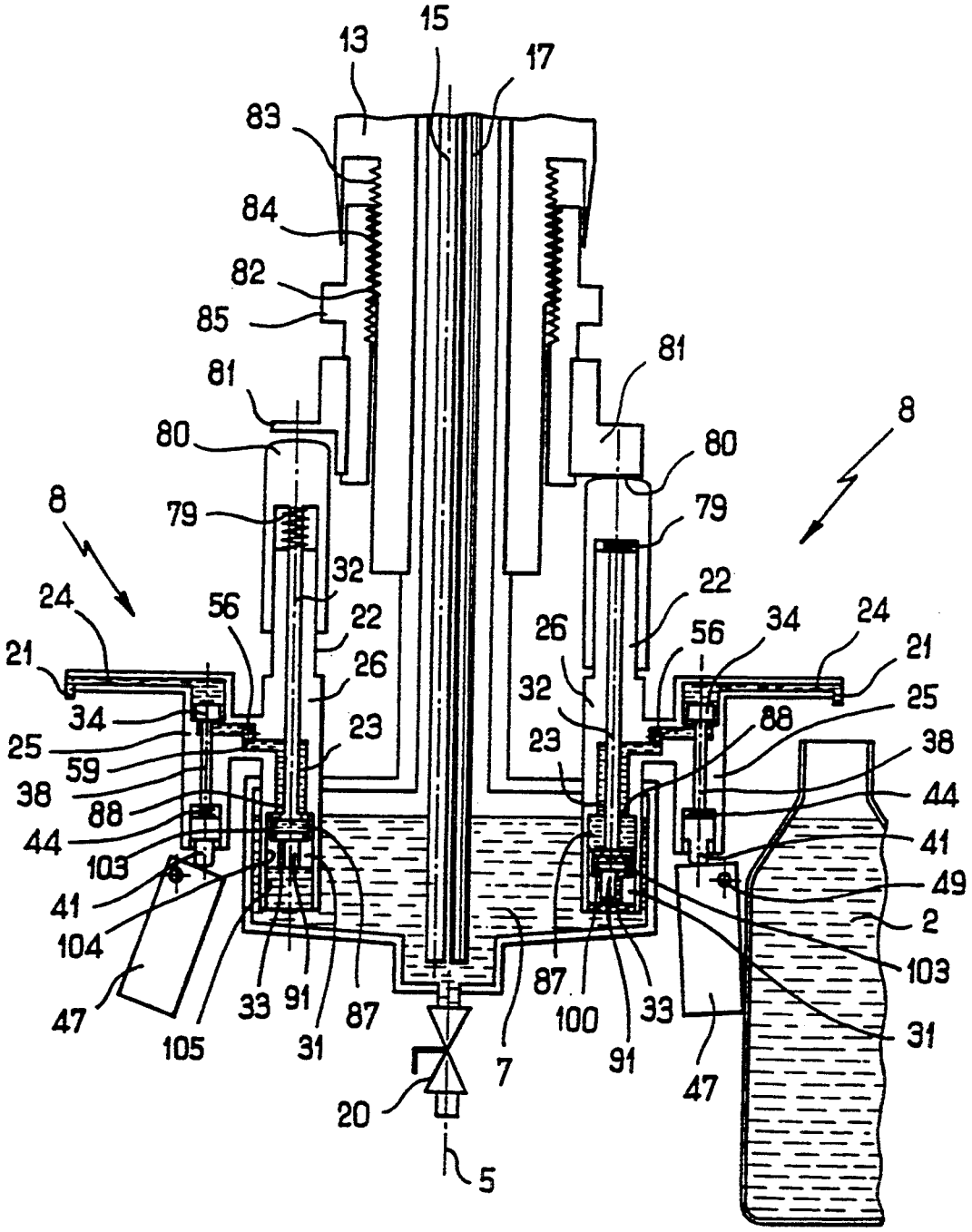
FIG. 2 is a fragmentary vertical section through metering-out apparatus of the invention and showing two operating positions.
Figure 3:
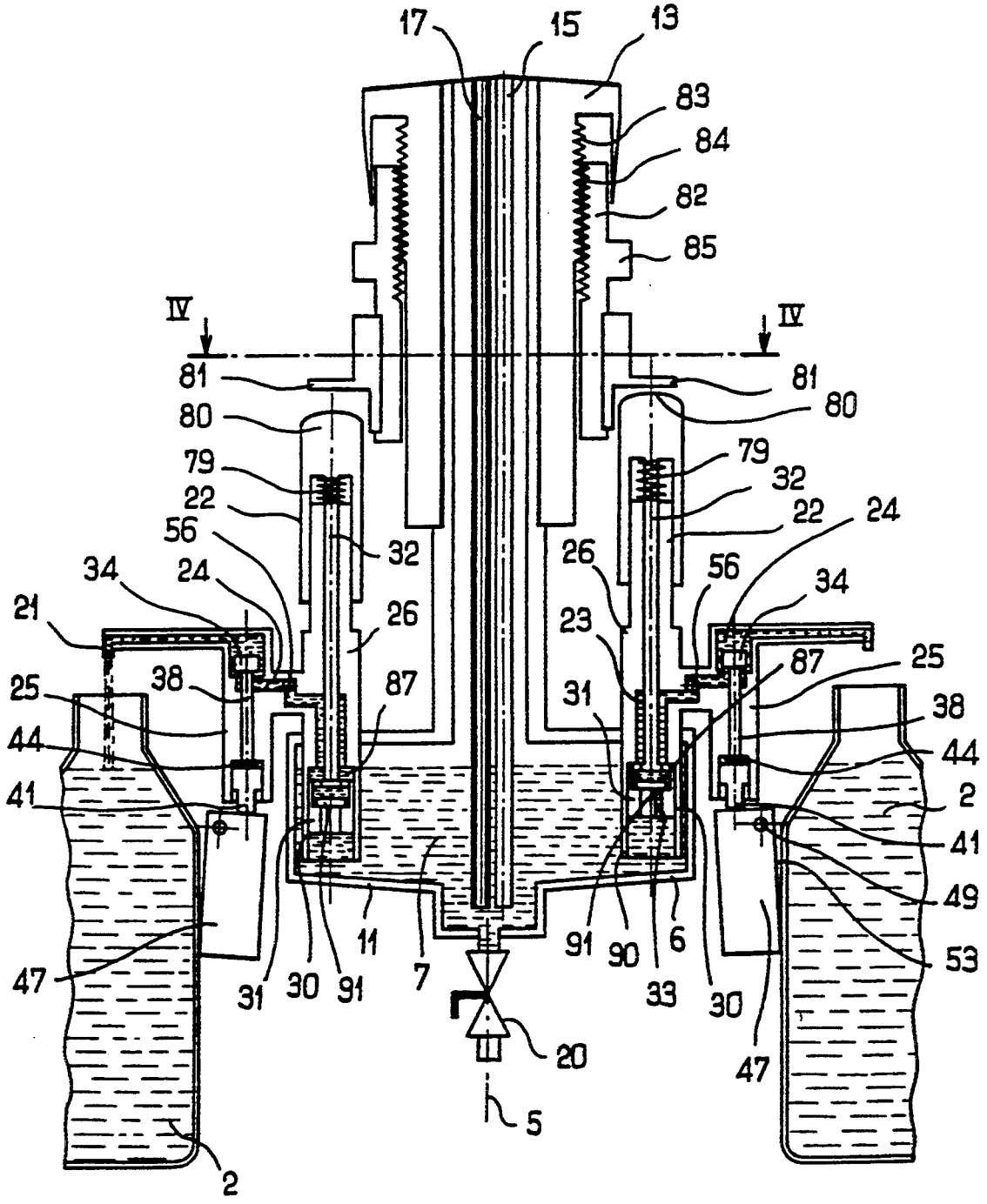
FIG. 3 is a fragmentary vertical section through metering-out apparatus of the invention showing two other operating positions.

Operation of the invention can be seen in FIGS. 2 and 3. To the left of FIG. 2, no container is in place beneath the spout 21 of the metering-out valve 8. The delivery shutter 34 is thus closed, as it the non-return valve 56. To the right of FIG. 2, the cam follower has moved vertically downwards by coming into contact with the control cam 81. The compression spring 89 is compressed, the transmission rod 32 has moved downwards, as has the plunger 31. The shutter member 91 is open and liquid penetrates into the liquid-taking chamber 87 via the insertion opening 33. Since the container 2 is in place facing the spout 21, the control shoe 47 pushes back the delivery shutter member 34 which is thus open. At the end of this metering-out step, when the control cam 81 moves suddenly vertically upwards relative to the cam follower 80, the cam follower 80 also moves upwards under the control of the return spring 79. Thus, the upward motion of the cam follower 80, of the transmission rod 32, and of the plunger 31 depends only on the return force of the spring 79. In the position shown to the left of FIG. 3, the shutter member 91 is closed, and the upward motion pumps the liquid from the liquid-taking chamber 87 to the spout 21 from which it is ejected into the container 2 via the non-return valve 56 which is open, and via the delivery shutter 34 which is also open. When the plunger piston 31 has travelled the full length of its vertical stroke in its housing 89, ejection of the liquid through the spout 21 is terminated, and the non-return valve 56 closes. Thereafter the container 2 is removed and the metering-out valve 8 is back in the disposition shown to the left of FIG. 2.

The metering-out device of the invention is thus very simple and extremely efficient from the point of view of accuracy of the quantity metered out and it has a long lifetime. In addition, the main cylinder 95 of the plunger 31 is associated at the free bottom end 102 of the transmission rod 32 in a removable manner, e.g. by means of tapping 120 co-operating with a thread on said free bottom end 102. It is thus easy to change the plunger 31 and replace it with a plunger whose insertion opening 33 and/or whose liquid-taking chamber 87 is of a diameter that is smaller or greater. The metered-out quantity of liquid can thus be varied. In addition, this metered-out quantity of liquid also depends on the vertical stroke given to the plunger piston 31, i.e. on the shape and the position of the control cam 31 relative to the stand 6.

The metering-out device 22 could also extend in a direction that is not strictly vertical, or it could even extend horizontally, with the plunger 31 being driven in reciprocating translation motion that is inclined or even horizontal in the liquid. In another variant, the plunger could be of the rotary type being driven with reciprocating rotary motion, in which case the shutter member closes a radial opening in a face that is radial relative to the axis of rotation of the plunger.

The metering-out apparatus 1 may also be implemented using a single metering-out valve 8, and instead of providing a stand 6 that rotates relative to a control cam 81 that is stationary, the stationary control cam 81 could be replaced by a cam that rotates about a horizontal axis and that acts against the cam follower 80 like a rocker. The rotary cam may be synchronized with the container drive means, or with any other form of drive means.

I claim:

1. A metering-out device for successively taking doses of liquid in timed manner from a tank, the device comprising a metering-out body for mounting in stationary manner relative to the tank, and reciprocating metering-out/pumping means driven by motion transmission means in reciprocating motion that operates in one direction to cause a predetermined quantity of liquid to be metered out and in the opposite direction to pump up the liquid, wherein the metering-out body has an end portion defining a housing permanently immersed during operation in the liquid of the tank, and the reciprocating metering-out/pumping means comprise a liquid-taking plunger reciprocally mounted in the housing of the end portion and permanently immersed during operation in the liquid of the tank, said liquid-taking plunger being hollow, and provided with an insertion through opening for inserting the liquid into a liquid-taking chamber located above the plunger and that communicates with an outlet channel formed in the body, and wherein the plunger carries a shutter member for closing the insertion opening and disposed to be open in the direction of motion that gives rise to metering out and to be closed in the direction of motion that gives rise to pumping.

2. A device according to claim 1, wherein the shutter member is of the type controlled by the pressure of the liquid as generated by the reciprocating motion of the plunger.

3. A device according to claim 1, wherein the shutter member is mounted to slide freely relative to the plunger in the liquid-taking chamber.

4. A device according to claim 1, including a leakage section between the liquid-taking chamber and the liquid in the tank, the leakage section being smaller than the insertion opening when the shutter member is in its open position, and adapted to maintain reciprocating motion of the plunger in the liquid when the outlet channel is shut.

5. A device according to claim 4, wherein the plunger is constituted by a hollow plunger piston guided in a housing formed in the body of the device at the end of the outlet channel which communicates with the liquid-taking chamber and wherein the leakage section is implemented by transverse clearance in the guiding contact between the outside surface of the plunger piston and the guide surface of the housing.

6. A device according to claim 1, wherein the plunger is constituted by a hollow plunger piston guided in a housing formed in the body of the device at the end of the outlet channel which communicates with the liquid-taking chamber.

7. A device according to claim 1, including drive means for creating motion of the plunger in at least one direction.

8. A device according to claim 7, wherein the drive means create motion of the plunger in one direction only, its opposite direction of motion being transmitted from motion created outside the device.

9. A device according to claim 8, wherein the drive means create plunger motion in the direction that gives rise to metering out.

10. A device according to claim 7, wherein the drive means are constituted by a return spring.

11. A device according to claim 1, wherein the plunger is mounted movable in vertical translation relative to the body of the device, wherein the motion transmission means drive the plunger with reciprocating up and down vertical translation motion, wherein the liquid-taking chamber is disposed above the insertion opening, and wherein the shutter member closes the insertion opening while the plunger is rising.

12. A device according to claim 11, wherein the transmission means include a vertical rod rigidly associated at its free bottom end with the plunger and extending upwards through the liquid-taking chamber and the outlet channel.

13. A device according to claim 12, wherein the top end of the transmission rod is associated with a cam follower for co-operating with a control cam to generate the downwards motion of the transmission rod.

14. A device according to claim 12, wherein the drive means are constituted by a compression spring extending vertically around the rod having its bottom end bearing against a bottom shoulder secured to the body of the device and having its top end bearing against a top shoulder secured to the transmission rod.

15. A device according to claim 1, wherein the cross-section of the liquid-taking chamber is greater than the cross-section of the insertion opening.

16. A device according to claim 1, wherein the cross-section of the liquid-taking chamber is greater than the cross-section of the outlet channel.

17. A device according to claim 1, wherein the cross-section of the outlet channel tapers from the liquid-taking chamber to its outlet end from the body of the device.

18. A metering-out valve for taking successive timed predetermined quantities of liquid, in particular sterile liquid, from a tank and for delivering it into containers placed successively and in timed manner beneath a spout of said metering-out valve, wherein the metering-out valve includes at least one metering-out device according to claim 1 and includes an outlet channel that communicates with a delivery channel formed in a body of the valve and opening out into the spout.

19. A metering-out valve according to claim 18, wherein the outlet channel of the device and the delivery channel define a path that is partially horizontal and rises continuously, extending from the insertion opening of the metering-out device to the spout.

20. A metering-out valve according to claim 18, including a delivery shutter interposed on the delivery channel and controlled to open when a container is facing the spout and to close otherwise.

21. A metering-out valve according to claim 20, wherein the delivery shutter is controlled to open by a moving control member displaced while a container is being installed facing the spout.

22. A metering-out valve according to claim 20, wherein the delivery shutter is caused to close by a return spring.

23. A metering-out valve according to claims 20, including a non-return valve interposed between the delivery shutter and the outlet channel of the metering-out device and preventing liquid from flowing back into the tank.

24. A metering-out valve according to claim 18, wherein the metering-out device is rigidly associated relative to the body of the metering-out valve, but in removable manner.

25. A metering-out valve according to claim 18, wherein the valve body is connected to the body of the metering-out device by means of a coupling.

26. A metering-out valve according to claim 25, wherein the coupling includes securing means for removably connecting the coupling to the tank.

27. A metering-out valve according to claim 25, wherein the coupling forms a fixing bracket common to the body of the metering-out device and to the body of the metering-out valve, for fixing them relative to the tank.

28. A metering-out valve according to claim 25, wherein the coupling includes a non-return valve interposed between the delivery shutter and the outlet channel of the metering-out device and preventing liquid from flowing back into the tank.

29. Metering-out apparatus for taking successive timed predetermined quantities of liquid, in particular a sterile liquid, and for delivering them into containers that are successively driven in timed manner by drive means, the apparatus comprising a stand forming a tank for the liquid, and wherein the metering-out apparatus includes at least one metering-out valve according to claim 18 mounted on the stand so that each metering-out device has its liquid-taking plunger immersed in the liquid.

30. Metering-out apparatus according to claim 29, wherein the operation of the liquid-taking plunger is controlled at least in part on the basis of the motion of drive means for driving the containers and at the rate of said drive means.

31. Metering-out apparatus according to claim 30, wherein motion of the liquid-taking plunger in one direction is controlled from the motion of the container drive means whereas motion of the liquid-taking plunger in the opposite direction is controlled by drive means belonging to and integrated in each metering-out device.

32. Metering-out apparatus according to claim 31, wherein the pumping motion of the liquid-taking plunger is controlled by a return spring.

33. Metering-out apparatus according to claim 31, wherein the metering-out motion of the liquid-taking plunger is controlled from the motion of the container drive means.

34. Metering-out apparatus according to claim 30, wherein each metering-out device includes a cam follower connected to the metering-out plunger, wherein it includes a control cam for co-operating with each cam follower to generate the metering-out motion, and wherein the control cam and the stand are movable relative to each other in relative motion generated by the container drive means.

35. Metering-out apparatus according to claim 34, wherein the control cam is rigidly associated with the stand via means for adjusting the distance between the control cam and the metering-out devices.

36. Metering-out apparatus according to claim 34, wherein the control cam is associated in fixed manner relative to a stationary support.

37. Metering-out apparatus according to claim 34, wherein the metering-out devices extend vertically, the stand is extended upwards by an extension and the control cam is a circular cam associated rigidly with a guide bearing of the extension above the metering-out devices.

38. Metering-out apparatus according to claim 30, wherein the stand of the tank includes projections for being engaged in slots in a moving member of the container drive means for imparting motion to said stand.

39. Metering-out apparatus according to claim 29, in the form of a carousel, the tank being in a bottom central position, its stand including a peripheral ring for supporting a plurality of regularly spaced-apart metering-out valves.

40. Metering-out apparatus according to claim 29, including means for maintaining a level of liquid in the tank above a predetermined threshold.

41. An installation for handling, processing, or filling a series of containers, wherein the installation includes at least one metering-out apparatus according to claim 29.

42. An installation according to claim 41, wherein the metering-out apparatus is rigidly associated with the top of one of a turntable of a rotary inlet and outlet star of a carousel for handling, processing, or filling containers.

* * * * *